US010337151B1

(12) United States Patent
Alotaibi

(10) Patent No.: US 10,337,151 B1
(45) Date of Patent: Jul. 2, 2019

(54) MOVABLE TRACK FOR BAREFOOT WALKING

(71) Applicant: Zabin S. S. Alotaibi, Kuwait (KW)

(72) Inventor: Zabin S. S. Alotaibi, Kuwait (KW)

( * ) Notice: Subject to any disclaimer, the term of this patent is extended or adjusted under 35 U.S.C. 154(b) by 0 days.

(21) Appl. No.: 16/278,681

(22) Filed: Feb. 18, 2019

(30) Foreign Application Priority Data

Apr. 25, 2018 (GC) ..... 201835186

(51) Int. Cl.
*A63C 19/10* (2006.01)
*E01C 1/00* (2006.01)
*A63C 19/00* (2006.01)

(52) U.S. Cl.
CPC ..... *E01C 1/002* (2013.01); *A63C 19/00* (2013.01)

(58) Field of Classification Search
CPC ... E01C 1/00; E01C 1/002; E01C 3/00; E01C 3/006; E01C 5/00; E01C 5/22; E01C 15/00; A63C 19/00; A63C 19/10
USPC ..... 472/88–92; 404/1, 17, 34, 44
See application file for complete search history.

(56) References Cited

U.S. PATENT DOCUMENTS 105,138 A * 7/1870 Cauvet et al.
4,038,834 A * 8/1977 Roberts ..... A63C 19/10 472/90
4,226,064 A * 10/1980 Kraayenhof ..... A01K 1/015 404/35
5,921,032 A 7/1999 Labinski
6,126,551 A * 10/2000 Martin ..... A63C 19/10 472/90
6,796,927 B2 9/2004 Toyama
7,648,420 B2 1/2010 Stroppiana
8,425,336 B2 * 4/2013 Munzlinger ..... A63C 19/10 404/41
9,057,160 B2 6/2015 Scott
9,624,682 B2 4/2017 Jamison
2005/0075179 A1 4/2005 Marcinkowska
2009/0286609 A1 * 11/2009 Dyrdek ..... A63C 19/10 472/89
2012/0083350 A1 * 4/2012 Frankowski ..... A63G 31/00 472/128

OTHER PUBLICATIONS

"A Barefoot Walk in Engelberg" Copyright © 2019 A Passport Affair, website: https://apassportaffair.com/barefoot-walks/.

* cited by examiner

*Primary Examiner* — Kien T Nguyen
(74) *Attorney, Agent, or Firm* — Richard C. Litman

(57) ABSTRACT

The movable track for barefoot walking is designed to provide healthy exercise and to prevent and heal chronic and casual diseases by walking in bare feet while executing a marathon on the movable track. The movable track for barefoot walking includes a movable/portable, lightweight, waterproof, fiberglass platform or base having a connected assembly of waling surface sections thereon. Each section has unique physical and medical benefits for use by a marathoner. The sections include: a first section having high and low areas of ground; a gravel and stone section; a sand section; a grass section; a water section; and a clay section. Provisions are made within the confines of the track for a water tank, pumping capabilities, clothing storage, bath facilities and appropriate controls.

19 Claims, 5 Drawing Sheets

MOVABLE TRACK FOR BAREFOOT WALKING

CROSS-REFERENCE TO RELATED APPLICATION

This application claims the benefit under 35 U.S.C. § 119 (a) of Gulf Cooperation Council (GCC) Patent Application Serial No. 2018-35186, filed Apr. 25, 2018, which is hereby incorporated by reference in its entirety.

BACKGROUND

1. Field

The disclosure of the present patent application relates to exercise facilities, and particularly to a movable track (the track may be moved to different locations) designed to provide healthy exercise by walking in bare feet while executing a marathon.

2. Description of the Related Art

Scientists performed a study through which they discovered that walking can prevent Alzheimer's disease, which is annually diagnosed in thousands of patients. Researchers from Cambridge University advise anyone who wants to reduce the risk of being affected with Alzheimer's disease to walk for twenty minutes, three times a week. It was found that one-third of Alzheimer's cases in Britain come from lifestyles including obesity, smoking and hypertension, and in particular, lack of sports activity. The researchers pointed out that physical activity ensures a regular supply of oxygen-rich blood to the brain, which prevents accumulation of the protein that causes Alzheimer's disease in the brain. Thus, the researchers emphasized that in the absence of any effective treatment for Alzheimer's disease, adults are able to reduce the risk of being affected with this disease by walking. Specialists of Yoga and bioenergy espouse the importance of walking on sand, stones and dust or gravel, and even on grass, which provides an enormous benefit to the participants' bodies. In addition, there are over 7200 nerve endings in the sole of the foot that are connected with body tissues and organs.

Prior art methods for providing these types of exercise involve the use of existing field or path types, such as grass fields, dirt fields, sand fields, concrete, big, smooth rocks, tiny pebbles, tiny sticks, bark, sand, mud and bodies of water. To use these outdoor facilities, users must travel to the location of the fields. In addition, rain, heat and cold weather make the use of these outdoor facilities limited, uncomfortable, and even unhealthy. Self-contained sports complexes can provide exercise activities, such as swimming, biking, running and walking. Again, users must travel to the location of the complex to take advantage of the facilities.

Thus a movable track for barefoot walking solving the aforementioned problems is desired.

SUMMARY

The movable track for barefoot walking is designed to provide healthy exercise and to prevent and heal chronic and casual diseases by walking in bare feet while executing a marathon on the movable track. The movable track for barefoot walking includes a movable/portable, lightweight, waterproof, fiberglass platform or base having a connected assembly of walking surface sections thereon. Each section has unique physical and medical benefits for use by a marathoner. The sections may include a first section having high and low areas of ground to make oxygen flow to the abductor muscle of the body and promote collagen flow to all body tissues; a gravel and stone section having rough stones to touch reflexive points in the feet and stimulate neurological signals in the brain; a sand section, which helps to reduce stress and distress, in addition to burning more calories than walking on a hard surface, protects the cardiovascular system, promotes the immune system, and stimulates the sweat glands and sensory endings in the sole of the foot; a grass section that affects the entire electromagnetic field in the body, as touching the grass with bare feet activates nerve endings that nourish body organs (including lungs, spleen, stomach, brain, and kidneys) with energy that helps to get rid of negative energy from the entire body; a water section for strengthening leg muscles and gristles (articular cartilage) of the knee (patella), helps to increase flexibility and strength of muscles and stimulates brain cells and memory strength; and a clay section that promotes balanced pressure on over 7200 nerve endings in the foot connected with body tissues and organs. Provisions are made within the confines of the track for a water tank, pumping capabilities, clothing storage, bath facilities and appropriate controls.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
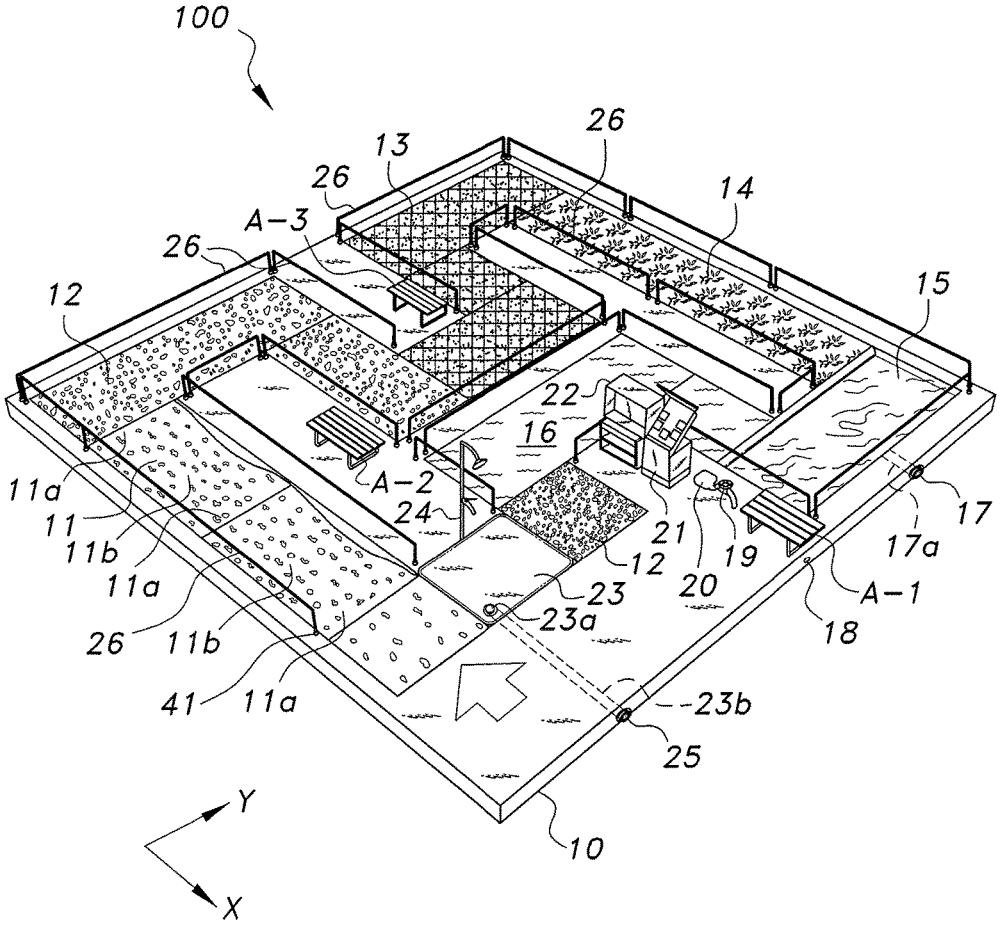
FIG. 1 is a perspective view of a movable track for barefoot walking.

FIG. 1 shows an exemplary movable track for barefoot walking 100 that is designed to provide healthy exercise by walking in bare feet through several different sections of the movable track 100. The movable track for barefoot walking 100 is defined by a portable main deep marathon base 10, which is made of lightweight, waterproof fiberglass. The base 10 supports a connected assembly of walking surface sections, each section having unique physical and medical benefits for use by a marathoner as described above. Each section includes one or more elongated portions having a length equal to or greater than its width. The first section 11 includes high areas 11*a* and low areas 11*b* of a solid surface (ground) simulating a hilly area and extends along a first X-axis. The second section 12 includes gravel and stones, some of which are rough stones. The second section 12 has a first portion extending along a second Y-axis, that is perpendicular to the X-axis, and a second portion extending parallel to the first section 11. The third section 13 includes sand and has a first portion extending along the Y-axis, a second portion extending along the X-axis, and a third portion extending along the Y-axis. The fourth section 14 includes a grass section and extends along the X-axis parallel to the first section 11. The fifth section 15 includes water and extends along the Y-axis. The sixth section 16 includes clay and has a first portion extending along the X-axis and a second portion extending along the Y-axis. The second section 12 also includes a third portion extending from the sixth section 16 along the X-axis. The track 10 is generally serpentine, ending substantially at or near the beginning. It will be understood that the particular pattern or layout of the track 10, the relative lengths and configuration of each of the sections 11-16, the number of the sections 11-16, and the order of the sections 11-16 shown in FIG. 1 are exemplary only, so long as the track 10 includes a plurality of sections having different topologies that provide exercise and variegated sensory stimulation through the soles of the walker's feet.

Figure 2:
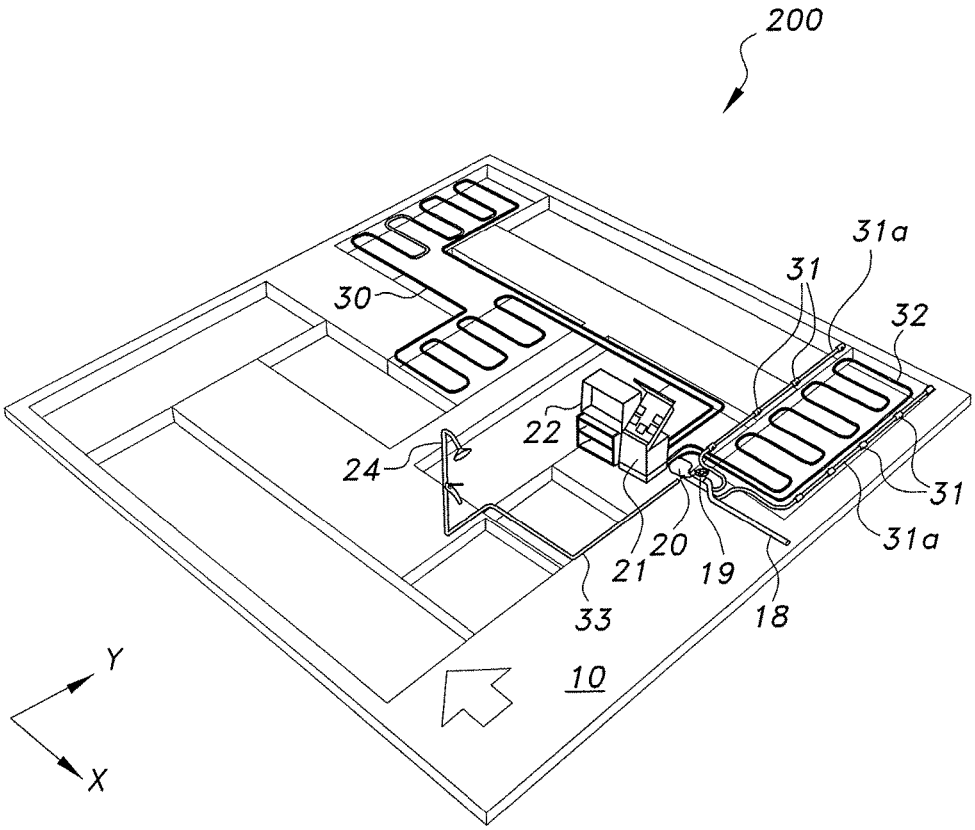
FIG. 2 is a perspective view of a plumbing system for the movable track of FIG. 1.
Figure 4:
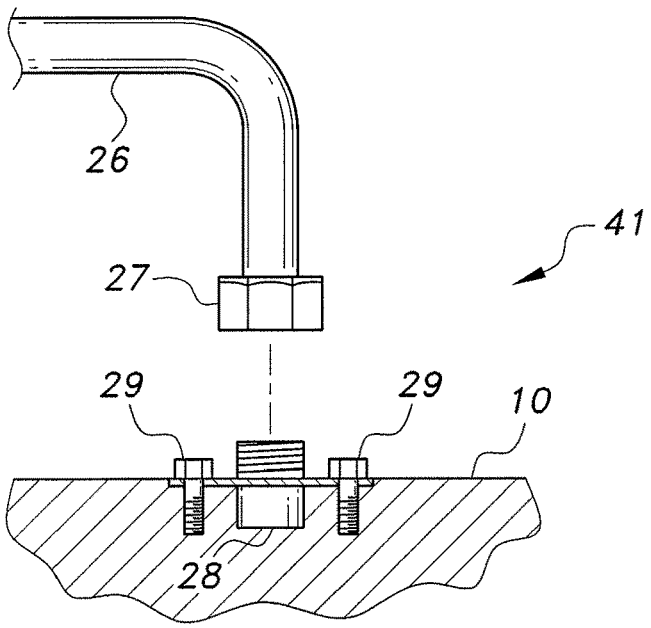
FIG. 4 is a fragmented perspective view of a fixing joint of the movable track of FIG. 1.

Other features of the movable track for barefoot walking 100 that can be seen in FIG. 1, include a bath (basin) 23 with shower head 24, for bathing or hand washing after finishing the marathon training (shown between the beginning and end of the track 10 in FIG. 1); a water pump 19 with a control button 20; a water inlet 18 connecting the water pump 19 housed in the base 10 with an outer water tank or supply (not shown); a control unit 21 for controlling water flow and heating and cooling in temperature control basins, as described below with respect to FIG. 2; a clothes cabinet 22 for storing clothes; three aid or resting stations or benches A-1, A-2 and A-3; and portable elongated side barriers 26 fixed along the two sides of the six sections 11-16 using fixing joints 41 (as described below with respect to FIG. 4).

The details of the plumbing system 200 for the movable track for barefoot walking are shown in FIG. 2. The water inlet 18 provides the water pump 19 with water from an outer water tank or supply (not shown) when it is activated by the button 20. The pump 19 supplies water to multiple bubble-type outlets 31 along the two long sides of the water section 15 via side pipes 31*a* to make bubbles and waves to massage the user's feet while walking. The details of the multiple bubble-type outlets 31 are described with respect to FIG. 5, below. Water is drained from the water section 15 via a drain (not shown) that is connected to a water section outlet 17 (shown in FIG. 1). The pump 19 also supplies water to the shower 24 through water pipe 33. Water is drained from the bath 23 via a drain 23*a* (shown in FIG. 1) that is connected to a basin water outlet 25.

The plumbing system 200 also includes two temperature control basins or extensions. A first temperature control extension 30 is located under the sand section 13, for providing heated or cooled water to heat or cool the sand therein in a controlled manner. A second temperature control extension 32 is located under the water section 15 to cool or heat the water in the water section 15 in a controlled manner. The two extensions 30 and 32 include a number of loops to maximize heat transfer to and from the sand and water in the respective sections. The two extensions 30 and 32 are connected to the control unit 21, which includes pumps (not shown) and heating and cooling unit (not shown) for providing the heated or cooled water to the extensions 30 and 32. The details of the control unit 21 are described with respect to FIG. 6, below.

Figure 3:
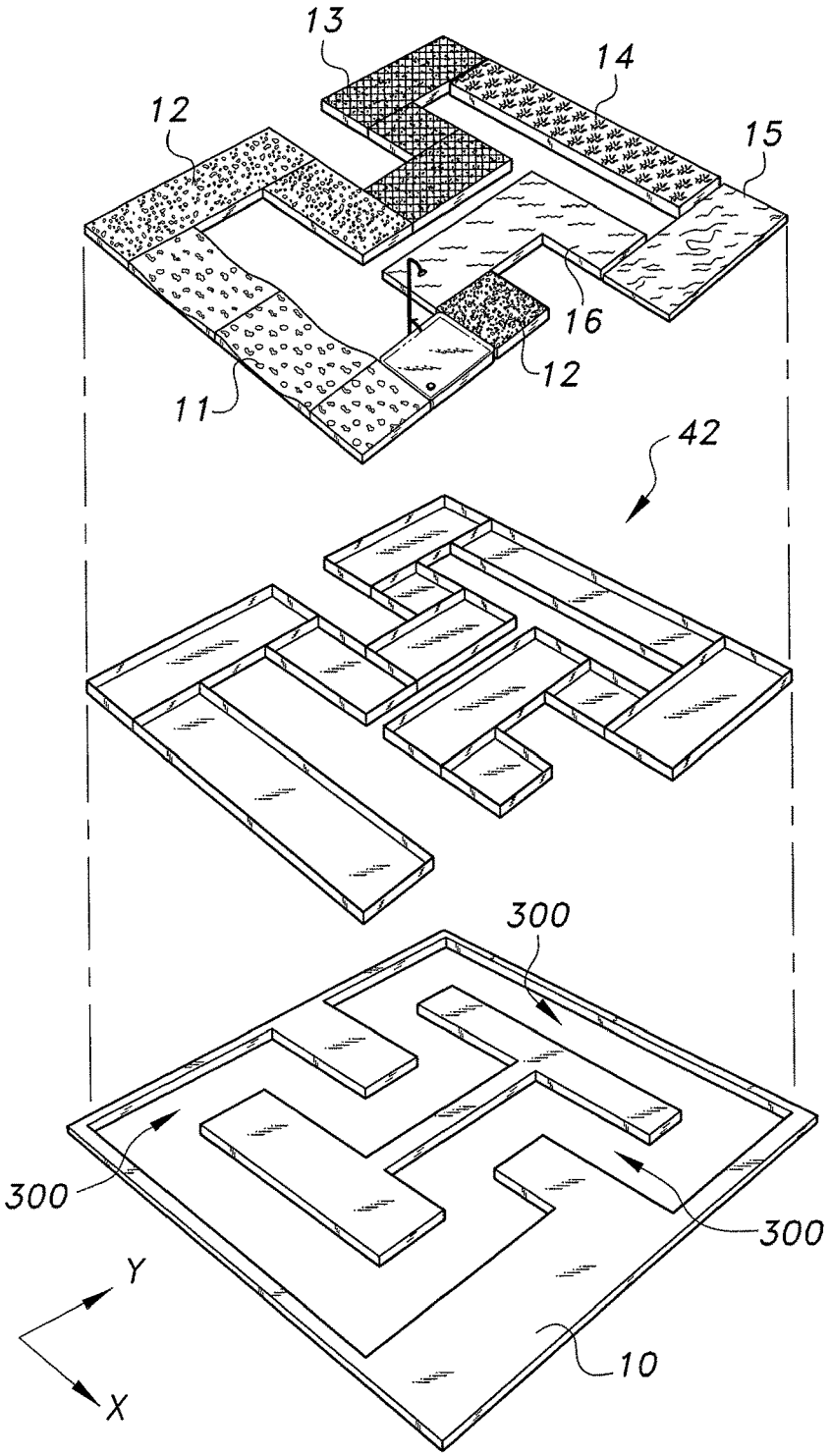
FIG. 3 is an exploded perspective view of the movable track of FIG. 1.

FIG. 3 shows an exploded view of an exemplary construction of the movable track for barefoot walking 100. In this example, the base 10 (which is made of lightweight, waterproof fiberglass) has recesses or grooves (or a single continuous groove, as shown in FIG. 3) to house a six-basin molds layout 42. The six sections 11-16 are housed in the six-basin molds layout 42 in the sequence to which they are to be traversed. It should be understood that the layout of the groove or grooves in the base 10 housing the six stages sections 11-16 may be of any shape or design, according to the user's needs or the recommendation of an expert.

The details of one of the fixing joints 41 are shown in FIG. 4. The fixing joint 41 includes a hex nut connected at the base end 27 of the side barriers 26. The hex nut engages threads on an extension (anchor) 28 that is connected to the base 10 by two side mounting bolts or screws 29.

Figure 5:
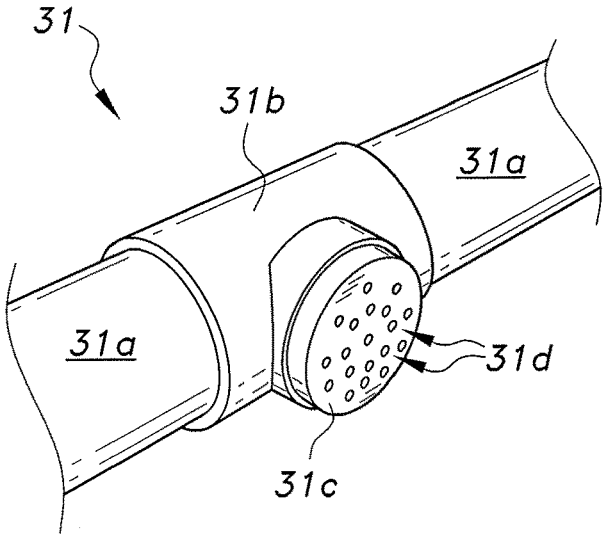
FIG. 5 is a fragmented perspective view of a multiple bubble-type outlet of the movable track of FIG. 1.

The details of one of the multiple bubble-type outlets 31 are shown in FIG. 5. The outlet 31 includes a T-fixture 31*b* that is attached between two sections of the side pipes 31*a*. The T-fixture 31*b* includes a circular flat face 31*c* facing the water section 15. The circular flat face 31*c* includes a plurality of orifices 31*d* for providing the bubbles and waves, as described above with reference to FIG. 2.

Figure 6:
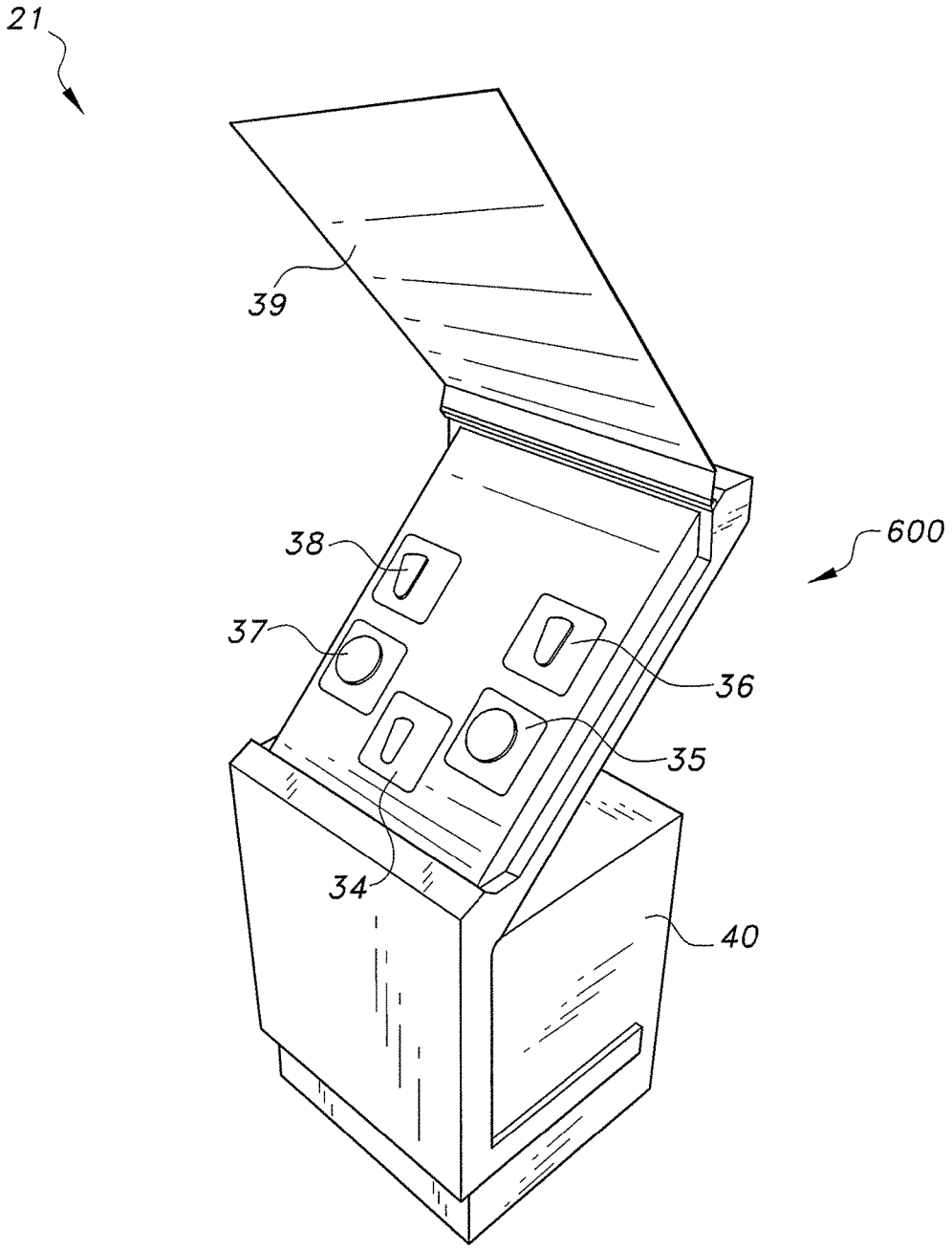
FIG. 6 is a perspective view of a control unit of the movable track of FIG. 1

The details of the control unit 21 are shown in FIG. 6. The control unit 21 includes a housing 600 and a main control switch 34 mounted on the housing 600 to operate (activate) the control unit 21. The control unit 21 also includes a control switch (section) 35 for controlling water heating and cooling through the second temperature control extension 32 located under the water section 15 to cool or heat the water in the water section 15, as described above. A water flow switch (section) 36 controls the water flow in the second temperature control extension 32. A sand basin control switch (section) 37 controls water heating and cooling through sand extension 30, while a water flow switch (section) 38 controls the water flow in the sand extension 30. A glass protective cover 39 is rotatably mounted on the housing 600 to protect the control unit switches from rain and dust. A side door 40 is provided on the housing 600 for access to the pumps, heaters, coolers and other components of the control unit 21.

It is to be understood that the movable track for barefoot walking is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A movable track for barefoot walking, comprising:

a base;

a plurality of sections supported on the base, the plurality of sections including:

a first section including high areas and low areas;

a second section including gravel and stones;

a third section including sand a fourth section including grass;

a fifth section including water, wherein the fifth section is elongated, having opposing sides, and includes multiple bubble-type outlets attached to the opposing sides; and a sixth section including clay, the first through sixth sections simulating a variety of terrains encountered in a marathon course; and a shower head disposed on the base.

2. The movable track according to claim 1, wherein the base is made of lightweight, waterproof fiberglass.

3. The movable track according to claim 1, further comprising a water pump housed in the base and connected to the multiple bubble-type outlets and the shower head, the water pump being adapted for supplying the multiple bubble-type outlets and the shower head with water from an outer water supply.

4. The movable track according to claim 1, further comprising a first temperature control extension located in the base under the third section for providing heated or cooled water to heat or cool the sand in the third section.

5. The movable track according to claim 4, further comprising a second temperature control extension located in the base under the fifth section for providing heated or cooled water to cool or heat the water in the fifth section.

6. The movable track according to claim 5, further comprising a control unit mounted on the base and connected to the first and second temperature control extensions for controlling water heating and cooling through the first and second temperature control extensions.

7. The movable track according to claim 1, further comprising a molds layout comprising a plurality of basins, the molds layout being mounted on the base.

8. The movable track according to claim 7, wherein the plurality of basins comprises six basins and wherein each of the six sections are housed in an associated one of the six basins in a sequence in which they are to be traversed by a barefoot walker.

9. The movable track according to claim 7, wherein the base has at least one groove, the plurality of basins being mounted in the at least one groove.

10. The movable track according to claim 1, further comprising a plurality of portable elongated side barriers fixed to the base along sides of the six sections.

11. The movable track according to claim 10, further comprising a plurality of fixing joints fixing the plurality of portable elongated side barriers to the base.

12. The movable track according to claim 11, wherein each said portable elongated side barrier has a base end, each of the plurality of fixing joints having:

a hex nut connected at the base end of one of said portable elongated side barriers; and a threaded anchor attached to the base, the hex nut engaging the threads on the anchor.

13. A movable track for barefoot walking, comprising:

a lightweight, waterproof fiberglass base having at least one groove defined therein;

a molds layout having six basins, the molds layout being mounted on the base with each of the basins being lodged in the at least one groove defined in the base;

a plurality of sections mounted on the molds layout, the sections including:

a first section having a walking surface including high areas and low areas simulating hilly marathon course terrain;

a second section having a walking surface including gravel and stones;

a third section having a walking surface including sand;

a fourth section having a walking surface including grass;

a fifth section having a walking surface including water and multiple bubble-type outlets along two long sides thereof; and a sixth section having a walking surface including clay, the sections being housed in an associated one of the six basins in a sequence in which they are to be traversed by a walker;

a shower head mounted on the base;

a water pump mounted in the base for supplying the multiple bubble-type outlets and the shower head with water from an outer water supply;

a first temperature control extension located in the base under the third section for providing heated or cooled water to heat or cool the sand in the third section;

a second temperature control extension located in the base under the fifth section for providing heated or cooled water to cool or heat the water in the fifth section;

a control unit mounted on the base and connected to the first and second temperature control extensions for controlling water heating and cooling through the first and second temperature control extensions;

a plurality of portable elongated side barriers fixed to the base along sides of the six sections; and a plurality of fixing joints attaching the side barriers to the base, each of the fixing joints having a hex nut connected at a base end of one of the side barriers and a threaded anchor connected to the base, the hex nut engaging the threads on the anchor.

14. A movable track for barefoot walking, comprising:

a base;

a plurality of sections supported on the base, the plurality of sections including:

a first section including high areas and low areas;

a second section including gravel and stones;

a third section including sand a fourth section including grass;

a fifth section including water; and a sixth section including clay, the first through sixth sections simulating a variety of terrains encountered in a marathon course; and a molds layout comprising a plurality of basins, the molds layout being mounted on the base.

15. The movable track according to claim 14, wherein the plurality of basins comprises six basins and wherein each of the six sections are housed in an associated one of the six basins in a sequence in which they are to be traversed by a barefoot walker.

16. The movable track according to claim 14, wherein the base has at least one groove, the plurality of basins being mounted in the at least one groove.

17. The movable track according to claim 14, further comprising a plurality of portable elongated side barriers fixed to the base along sides of the six sections.

18. The movable track according to claim 17, further comprising a plurality of fixing joints fixing the plurality of portable elongated side barriers to the base.

19. The movable track according to claim 18, wherein each said portable elongated side barrier has a base end, each of the plurality of fixing joints having:

a hex nut connected at the base end of one of said portable elongated side barriers; and a threaded anchor attached to the base, the hex nut engaging the threads on the anchor.

* * * * *